US007411375B2

(12) United States Patent
Konrad et al.

(10) Patent No.: US 7,411,375 B2
(45) Date of Patent: Aug. 12, 2008

(54) APPARATUS FOR ISSUING AN ELECTRICAL OUTPUT SIGNAL

(75) Inventors: Stephan Konrad, Rieden (DE); Thomas Haerle, Oy-Mittelberg (DE); Christian Schneid, Nesselwang (DE)

(73) Assignee: Endress + Hauser Wetzer GmbH + Co. KG, Nesselwang (DE)

( * ) Notice: Subject to any disclaimer, the term of this patent is extended or adjusted under 35 U.S.C. 154(b) by 0 days.

(21) Appl. No.: 11/407,292

(22) Filed: Apr. 20, 2006

(65) Prior Publication Data

US 2006/0261791 A1 Nov. 23, 2006

Related U.S. Application Data

(60) Provisional application No. 60/672,867, filed on Apr. 20, 2005.

(30) Foreign Application Priority Data

Apr. 20, 2005 (DE) ..... 10 2005 018 398

(51) Int. Cl.
*G05F 1/10* (2006.01)

(52) U.S. Cl. ..... 323/273; 323/298; 323/303; 323/353; 327/108

(58) Field of Classification Search ..... 323/247, 323/273, 293, 298–299, 303, 353
See application file for complete search history.

(56) References Cited

U.S. PATENT DOCUMENTS 3,986,101 A * 10/1976 Koetsch et al. ..... 323/275
5,491,404 A * 2/1996 Settles et al. ..... 323/283
5,570,004 A * 10/1996 Shibata ..... 323/303
6,483,684 B2 * 11/2002 Isobe ..... 361/93.9
6,545,513 B2 * 4/2003 Tsuchida et al. ..... 327/108
6,825,644 B2 * 11/2004 Kernahan et al. ..... 323/283
7,012,791 B2 * 3/2006 Kikuchi ..... 361/18
2002/0074980 A1 * 6/2002 Sander ..... 323/274
2002/0097031 A1 * 7/2002 Cook et al. ..... 323/273
2004/0178777 A1 * 9/2004 Bayadroun ..... 323/274
2005/0078024 A1 * 4/2005 Harrington ..... 341/155

FOREIGN PATENT DOCUMENTS

DE 3 539 848 5/1987
GB 2 081 990 A 2/1982

* cited by examiner

*Primary Examiner*—Jeffrey L. Sterrett
*Assistant Examiner*—Stuart Hansen
(74) *Attorney, Agent, or Firm*—Bacon & Thomas, PLLC

(57) ABSTRACT

An apparatus for issuance of at least one electrical output signal (Iout), wherein the desired electrical current level of the output signal (Iout) is predeterminable, including: at least one measuring resistor, at which the electrical current level of the output signal (Iout) is measurable; at least one adjuster, via which the electrical current level of the output signal (Iout) is settable; and at least one controller, which compares the electrical current level of the output signal (Iout) measured at the measuring resistor with the electrical current level desired for the output signal (Iout), and which controls the electrical current level of the output signal (Iout) via the adjuster; wherein the controller and the measuring resistor are connected with an electric base-potential (VGND); and wherein the base-potential (VGND) is a reference potential for the controller.

5 Claims, 7 Drawing Sheets

APPARATUS FOR ISSUING AN ELECTRICAL OUTPUT SIGNAL

TECHNICAL FIELD

The invention relates to an apparatus for issuing at least one electrical output signal (Iout).

BACKGROUND OF THE INVENTION

Measuring devices having a so-called "4 to 20 mA" signal use a signal output, on which a current signal is issued for communicating measured data. For this purpose, the electrical current range between 4 and 20 mA is used for the output signal. The current signal can, in such case, be injected into the current loop from a current sink or from a current source. Additionally, there is the possibility of a single-pole, or a two-pole, signal output. In the case of the single-pole variant, the current is injected into an external load resistor via an output, and the return line for the current is outside of the device. In the case of the two-pole variant, the return line is through a second pole, into the device.

The following are requirements for a suitable current source:

1. The current source injects into the external load an electrical current which is independent of the load;
2. The output current is controllable from a controller or microprocessor; and
3. The current output fulfills high requirements as regards linearity, temperature drift and stability and is, also, manufacturable cost-favorably and in high numbers of pieces.

Current sources controlled both with open-loop control and with closed-loop control are known. For an open-loop controlled current-source, components with extremely close tolerances, thus expensive components, are required. Alternatively, the applied resistors must be trimmed, an option which increases complexity and does not fit with efficient manufacture. Furthermore, drift in the components e.g. as a function of temperature, leads to undesired altering of the output current.

In the case of closed-loop-control current-sources, the output current at a measuring resistor is measured and compared with a desired value. Deviations are controlled to zero using an adjuster. A problem here, especially in the case of a single-pole current source, concerns measurement of the output signal at the measuring resistor. This measurement usually makes an amplifier necessary, via which uncertainties and fluctuations in the measurement can arise.

SUMMARY OF THE INVENTION

An object of the invention, therefore, is to provide, especially for a measuring device, a closed-loop controlled, single-pole, current output, which is cost-favorable, accurate, and relatively free of drift.

The object is achieved, according to the invention, by an apparatus for issuing at least one electrical output signal (Iout), wherein the desired level of electrical current of the output signal (Iout) can be predetermined, including: at least one measuring resistor, at which the electrical current level of the output signal (Iout) can be measured; at least one adjuster, via which the electrical current level of the output signal (Iout) can be adjusted; and at least one controller, which compares the electrical current level of the output signal (Iout) measured at the measuring resistor with the desired electrical current level for the output signal (Iout), and which controls the electrical current level of the output signal (Iout) via the adjuster; wherein the controller and the measuring resistor are connected to an electrical base-potential (VGND); and wherein the base-potential (VGND) is a reference potential for the controller. The invention, thus, is associated with the feature that the reference potential of the controller, and the potential, to which the measuring resistor is connected, are identical. Both the controller and also the measuring resistor are connected to the same potential. The controller controls, therefore, the output signal with reference to the potential to which the measuring resistor is connected. This potential, VGND, changes with the electrical current level of the output current and with the value of the load resistance. Usually, in the case of single-pole current-sources, the controller lies at a fixed reference potential, ground (GND) or V−, and the measuring resistor lies between the upper potential V+ and the electrical current output. In such case, the voltage, with which the measuring device is supplied, results from the lower potential V− and the upper potential V+. Use of the invention means that an amplifier is no longer needed for equalizing the different potentials, which are usually given.

An embodiment provides that the adjuster involves an electrical component having an adjustable electrical resistance. The adjuster is, most often, arranged directly or indirectly between the upper potential V+ and the electrical current output. The voltage drop across this adjuster, being controllable via the adjustable value of resistance, leads to a corresponding electrical current level of the output signal Iout.

Another embodiment includes at least one signal output provided for the issuing of the output signal Iout. In the case of a one-channel, or single-pole, current source, exactly one signal output is involved.

Another embodiment provides an apparatus and a load resistor receiving the output signal Iout are connected with a lower electric potential V−. Via this lower potential V−, in effect, the grounding and the feedback of the current of the output signal Iout are made possible. The load resistor is usually outside of the apparatus, thus externally arranged.

Another embodiment includes a measuring resistor and the adjuster connected in series, that the measuring resistor is connected with the signal output, and that the adjuster is connected with an upper electric potential V+. In this way, a voltage drop occurs across the adjuster and across the measuring resistor. Additionally, the electrical current level of the output signal Iout can, therefore, be determined at the measuring resistor.

Another embodiment includes at least one voltage reserve in series with the adjuster, the voltage reserve being embodied in such a manner that it prevents the subceeding, or falling beneath, of a minimum voltage drop between the upper potential (V+) and the signal output in the case that the electrical resistance value of the adjuster has a low value, as measured in ohms. By this embodiment, the minimum supply voltage is assured for the digital/analog converter and for the controller. This voltage reserve can be implemented, for example, by a Zener diode.

Another embodiment provides that a connection of the controller for the reference potential VGND is connected with a point between the measuring resistor and the adjuster. The reference potential for the controller then results from the potential at the point between the adjuster and the measuring resistor.

Another embodiment provides that at least one microprocessor is provided, which establishes a digital desired-value (Ddes) for the desired current level of the output signal (Iout). Via the microprocessor, a simple and reliable establishing of the output signal can be implemented. The microprocessor, as controller, can, therefore, transfer the won measured values onto the output signal in the case in which the apparatus for signal issuing is part of a measuring device.

Another embodiment provides that at least one digital/analog converter is provided, which converts the digital desired-value (Ddes) of the microprocessor, or a signal (Ddes*) dependent thereon, into an analog desired-value (Vdes). The analog components require an analog signal, or analog comparison values. Therefore, between the microprocessor and the remaining, analog units of the current output, an appropriate converter is required.

Another embodiment includes at least one level converter, which adapts the level of the digital/analog converter. A difficulty is present, when the microprocessor lies at another reference potential than the controller and the digital/analog converter. In order that the digital/analog converter can work correctly, a level converter must eliminate this difference in potentials.

The invention relates, additionally, to a measuring device, which includes the apparatus for issuing at least one electrical output signal (Iout) according to at least one of the above embodiments. In such case, a measuring device is involved, which determines and/or monitors at least one process variable of a medium. The process variable can be, for example, temperature, fill level, pH-value, electrical conductivity, density or viscosity of a medium in a pipe or in any container, e.g. a tank. The measuring device has, therefore, in one embodiment, a corresponding current output, whose output signal lies within a range, preferably between 4 and 20 mA. The measuring device can, however, be embodied, in connection with the current output of the invention, also for a bus connection of any kind.

BRIEF DESCRIPTION OF THE DRAWINGS

The invention will now be explained in greater detail on the basis of the appended drawings, the figures of which show as follows.

DESCRIPTION OF THE PREFERRED EMBODIMENTS

Figure 1:
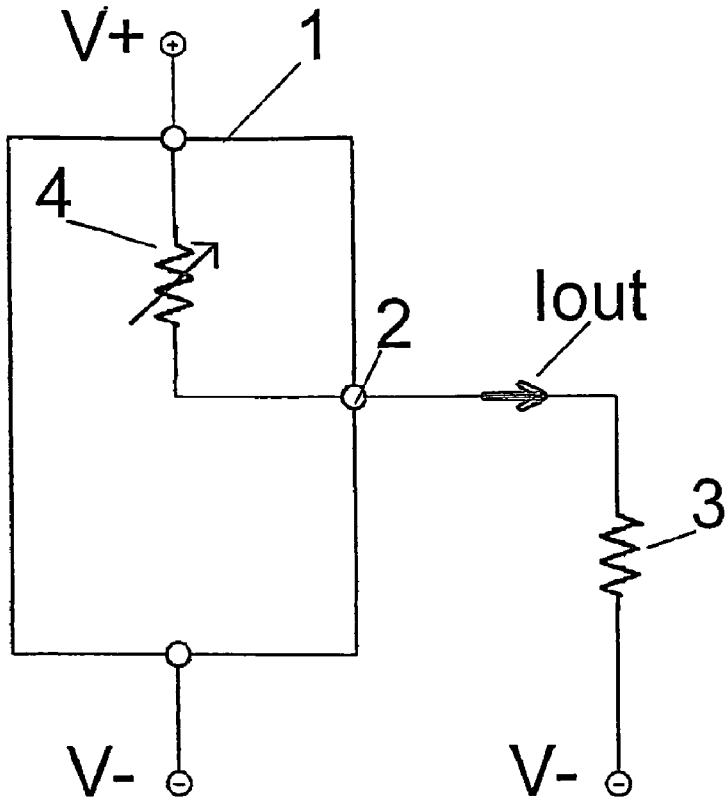
FIG. 1 a schematic drawing of a measuring device having a single-pole, electrical current output.

FIG. 1 shows a measuring device 1 using a single-pole signal-output 2. Instead of the measuring device 1, it can also be any electrical device having such a current output. 4 to 20 mA current outputs are widely used as signal outputs for measured variables. The current can be injected into the current loop from a current sink or from a current source. An active current output can be embodied as a single-pole variant or as a two-pole variant. In the case of the single-pole variant, a current Iout is injected by a single-pole signal-output into an external load resistor 3, and the feedback of the current occurs externally. In the case of the two-pole variant, feedback occurs through the second pole into the device.

The measuring device 1 of FIG. 1 is connected with the two electric potentials V+ and V−. The level of the electric current of the output signal Iout is settable by the adjuster 4, which can be, for example, a resistor having an adjustable value of resistance.

Figure 2:
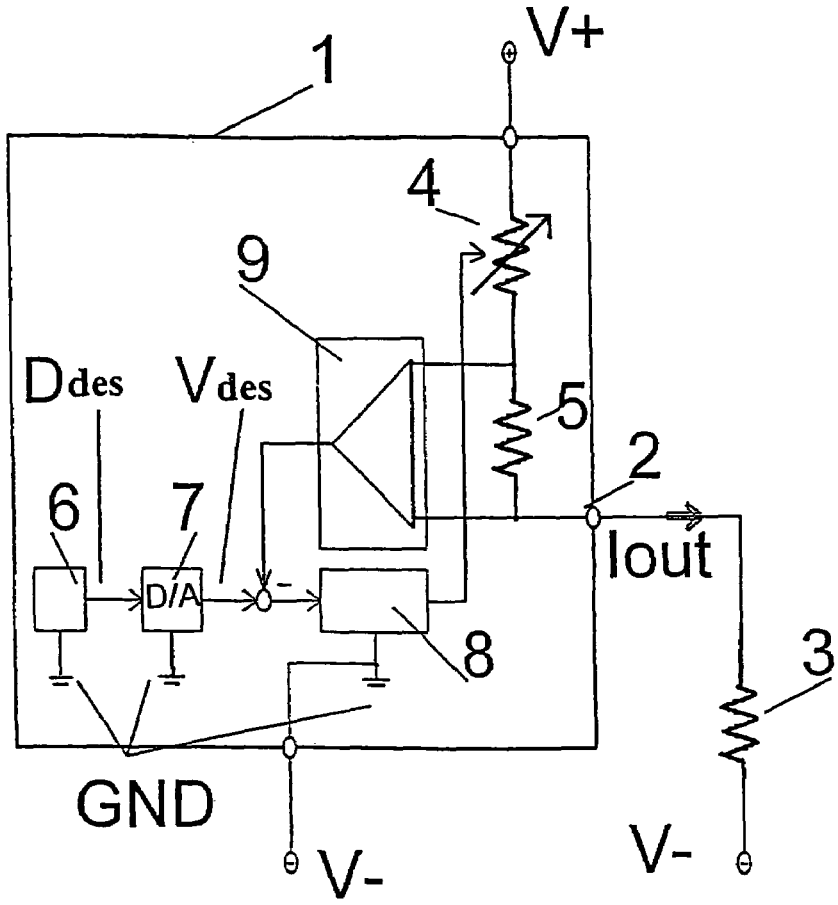
FIG. 2 a schematic drawing of a controlled, single-pole, electrical current output according to the state of the art.

In the embodiment of FIG. 2, the electrical current output is controlled according to the state of the art. In the control of the electrical current, the actual output current Iout is measured and compared with the desired value. A controller 8 then adjusts the output current Iout until it corresponds to the desired value. The microprocessor 6 produces a digital desired value Ddes, which is converted by a digital/analog converter 7 into the analog desired voltage Vdes. The controller 8 controls to zero, by means of the adjuster 4, an occurring deviation, as determined at the node between the output of amplifier 9 and the output of the digital/analog converter 7 by the difference between the desired voltage Vdes and the voltage drop across the measuring resistor 5 caused by the output current Iout. In such case, the entire system, composed of the microprocessor 6, the digital/analog converter 7 and the controller 8, works with the common reference potential GND, or ground, or V−. The disadvantage of this solution lies in the measuring of the output current Iout. The voltage drop across the measuring resistor 5 is not referenced to the common reference potential GND and must, therefore, be converted onto this potential. Because the common-mode voltage at the measuring resistor 5 changes with the load and the output current Iout, a common-mode error can arise, which again leads to a dependence on the load and on the output current Iout. Also entering are offset variables and non-linearities of the amplifier 9, which lead to errors in the output current Iout. Thus, current measurement must be done with a very high-quality, and correspondingly expensive, instrument amplifier 9 suited, additionally, for the high operating voltages. If one wants to fulfill the requirements, this solution is very expensive and, therefore, unsuitable.

Figure 3:
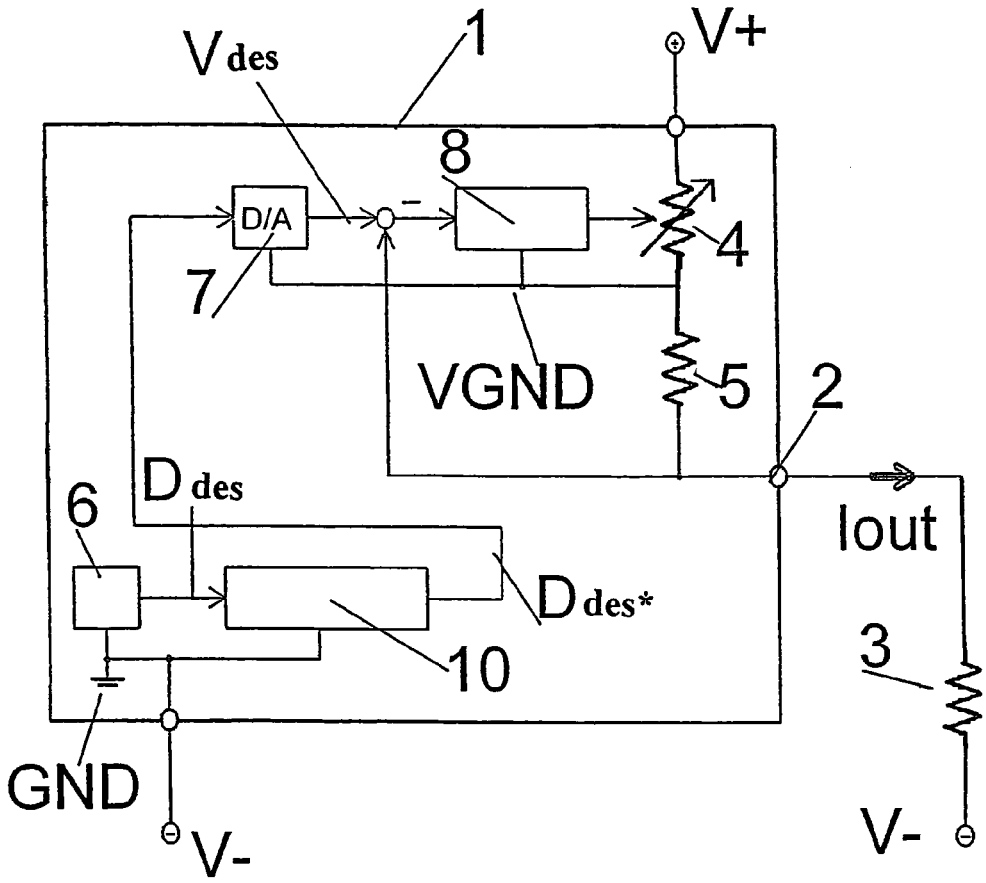
FIG. 3 an embodiment of a current output of the invention.

FIG. 3 shows the solution of the invention with the "floating current source". In the case of the floating current source, the control works not with reference to ground/GND, but, instead, with reference to the inwardly directed connection of the measuring resistor 5. This "virtual ground" VGND is not a fixed potential, but, instead, results via the resistance RL of the load resistor 3, the resistance RM of the measuring resistor 5 and the electrical current level of the output signal Iout according to the formula: VGND=(RL+RM)*Iout. This means, that the "virtual ground" VGND changes with the load 3 and the output current Iout. The whole current source "floats" on the potential VGND.

The microprocessor 6 produces the desired signal Ddes, which, in this example, is changed by a level converter 10. The desired value Ddes* produced by the level converter 10 is then converted by the digital/analog converter 7 into the desired voltage Vdes. The controller 8 and the measuring resistor 5 are, in this example, directly connected. Both thus lie at the same potential VGND. The controller 8 controls, as in the state of the art (FIG. 2), the difference, between the desired voltage Vdes and the voltage dropping across the measuring resistor 5, to zero via the adjuster 4. The advantages of this embodiment of the invention are: Because the measuring resistor 5 and the remainder of the control 8,7,4 have, here, the same reference in the "virtual ground" VGND, the voltage at the measuring resistor 5 can be fed directly to the controller 8, without amplifier 9. Consequently, the above-discussed disadvantages of the controlled current source are no longer present. Instead of the voltage at the measuring resistor 5, in the circuit of the invention, only the digital desired value Ddes produced by the microprocessor 6 needs to undergo a level change, since the microprocessor 6 continues to work with reference to GND and not with reference to VGND like the digital/analog converter 7. This level changing, however, can be accomplished much more simply, since the microprocessor 6 forwards the desired value Ddes in digital form to the digital/analog converter 7 and a digital value is defined by only two states, two levels. Thus, it is sufficient to alter these states of the signal in level by the level converter 10. Analog errors, such as common-mode disturbances, offset variables and non-linearities have, in such case, no influence.

Figure 4:
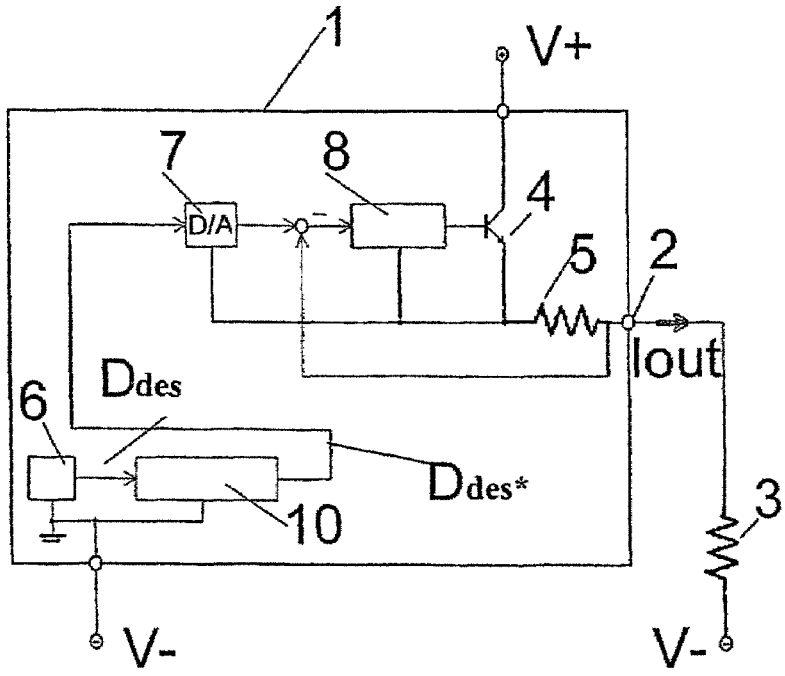
FIG. 4 an embodiment as in FIG. 3, in which a concrete example is given for the adjuster.

In the case of the adjuster 4 in FIG. 4, such is, for example, a bipolar transistor. Alternatively, a field effect transistor can be used as an adjustable resistance. The remainder of the circuit of FIG. 4 is identical to that of FIG. 3.

Figure 5:
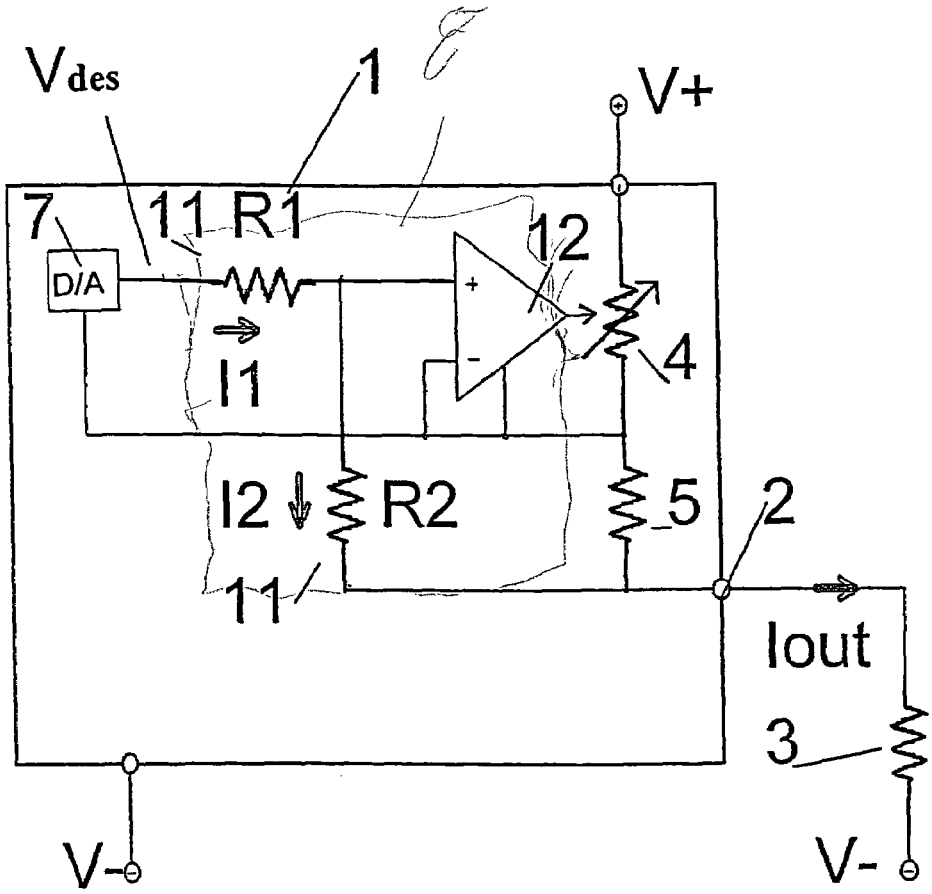
FIG. 5 an embodiment corresponding to FIG. 3, with an example of an embodiment of the control.

FIG. 5 presents an example of an embodiment of the controller 8. For the sake of not being repetitive, the components caring for the desired value Vdes have been reduced to the digital/analog converter 7. The control in this example is effected by the operational amplifier 12 and the two resistors 11 (R1 and R2), i.e. the control 8 is given here by the operational amplifier 12 and the two resistors 11, R1 and R2. The currents I1 and I2 flow, respectively, through the resistors R1 and R2. In such case, I1−I2=0. The output signal has the electrical current level Iout=(Vdes*R2)/(RM*R1). The control action can be adapted by introducing appropriate time constants. This arrangement has proven to be very stable.

Figure 6:
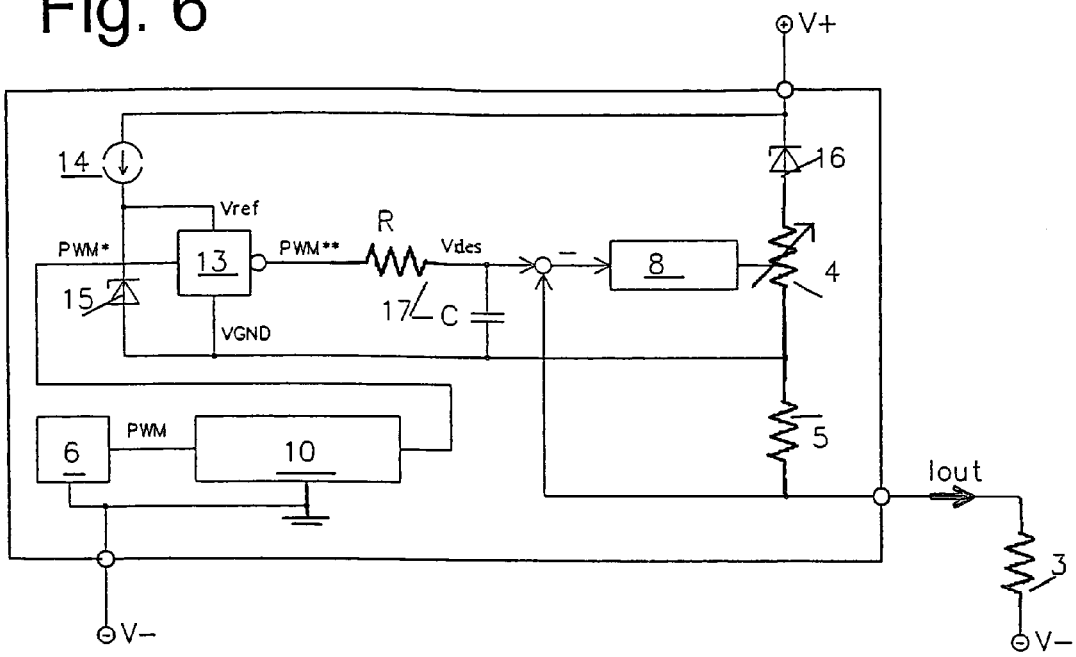
FIG. 6 an embodiment of the apparatus of the invention as in FIG. 3, with an example of an embodiment of the analog/digital converter.

FIG. 6 shows, by way of example, an embodiment of the digital/analog converter 7 of the circuit of the invention. The digital/analog converter (DAC) has the task of generating, from the level-converted, digital, desired value Ddes*, the analog reference signal Vdes for the control. In principle, any kind of DAC can be used for this. One possibility for the digital/analog conversion is a lowpass-filtered PWM-signal, as shown in FIG. 6. Microprocessor 6 produces a digital signal PWM, which corresponds to the digital desired value Ddes of the previous figures; by the label which it is given here, however, the special character of this desired value is stressed. A driver component 13, which receives the reference voltage Vref as its supply voltage, converts the level-converted signal PWM*, which corresponds to the value Ddes* of the previous figures, to a signal PWM of defined level. The reference voltage can be produced e.g. with an electrical current source 14 and a two-pole voltage reference 15. In a following lowpass 17 (formed of a resistor and a capacitor), the DC fraction of the signal is filtered out—this thus involves an averaging—and used as the desired value Vdes. For the functioning of the reference voltage source 15, the driver 13 and the controller 8, a minimal operating voltage is needed. In order to assure this voltage, thus in order to prevent that the voltage drop across the adjusting member 4 becomes too small, a voltage reserve 16 is necessary. Such a voltage reserve 16** can be implemented e.g. by a Zener diode, as illustrated here.

Figure 7:
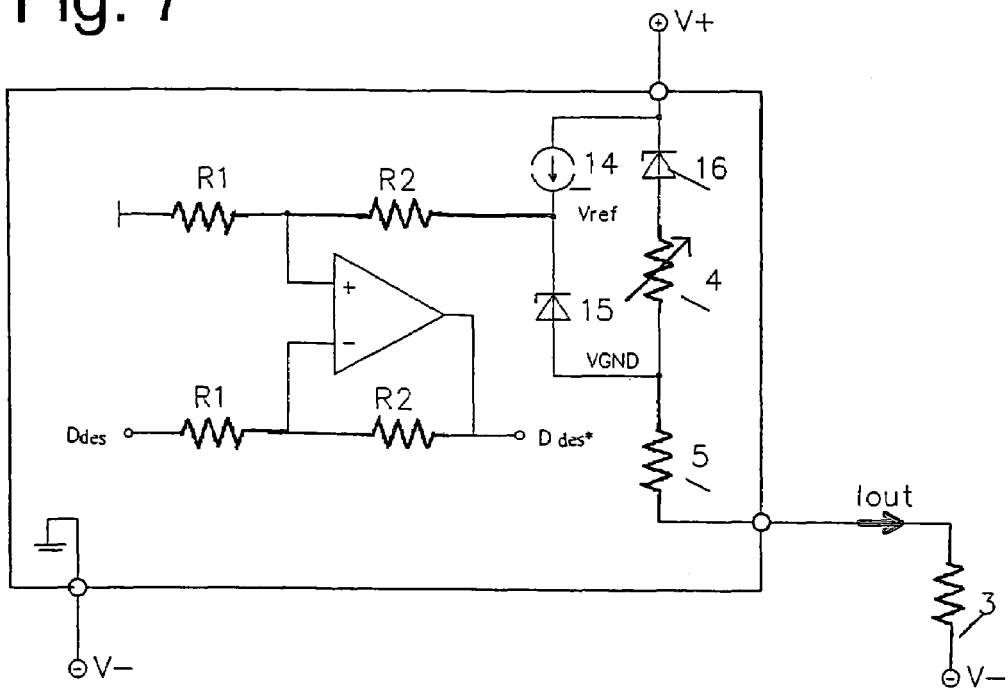
FIG. 7 an embodiment of the apparatus of the invention as in FIG. 3, with an example of an embodiment of the level converter.

FIG. 7 presents an example of a level converter 10. Level converter 10 has the task of adapting the digital output signals of the microcontroller to the level of the DAC. In such case, a serial, or a parallel, level converter can be involved, depending on how the DAC is actuated. For transmitting a PWM signal—see the preceding FIG. 6—a one-channel level converter is sufficient. A possible embodiment of the one-channel lever converter, using an operational amplifier working as a subtractor, is shown in FIG. 7. For a digital/analog converter which is actuated in parallel, a plurality of these level converters must be operated in parallel. Also an optocoupler or a transformer can be used as level converter. This FIG. 7 also shows that the lower potential V− is ground for the measuring device, or for the signal output, as the case may be.

LIST OF REFERENCE CHARACTERS

1 measuring device
2 signal output
3 load resistor
4 adjuster
5 measuring resistor
6 microcontroller
7 digital/analog converter
8 controller
9 amplifier
10 level converter
11 resistor
12 operational amplifier
13 driver
14 current source
15 voltage reference
16 voltage reserve
17 lowpass

The invention claimed is:

1. An apparatus for the output of at least one electrical output signal (Iout), wherein the desired electrical current level of the output signal (Iout) is predeterminable, comprising:

at least one measuring resistor, at which the electrical current level of the output signal (Iout) is measurable;

at least one adjuster, via which the electrical current level of the output signal (Iout) is settable;

at least one controller, which compares the electrical current level of the output signal (Iout) measured at said at least one measuring resistor with the electrical current level desired for the output signal (Iout), and which controls the electrical current level of the output signal (Iout) via said at least one adjuster;

at least one microprocessor, which provides a digital desired value (Ddes) for the electrical current level of the output signal (Iout):

at least one digital/analog converter which lies at the base potential of (VGND) and which converts the digital desired value (Ddes) of said at least one microprocessor, or a signal (Ddes*) independent thereon, into an analog value (Vdes);

said at least one microprocessor lies at a reference potential other than that of said at least one controller and said at least one digital/analog converter; and at least one level converter, which adapts the level of said digital/analog converter, wherein:

at least one signal output is provided for issuing the output signal (Iout) to a load resistor;

said controller and said measuring resistor are connected with a base-potential (VGND), which changes with said electrical current level of said output signal (Iout) and with the value of the load resistor;

the base-potential (VGND) is a reference potential for said controller, said adjuster comprises an electrical component having an adjustable electrical resistance;

a connection of said at least one controller for the reference potential (VGND) is connected with a point between said at least one measuring resistor and said at least one adjuster: and said at least one level converter adapts the digital output signals of said at least one microprocessor to the level of said digital/analog converter.

2. Apparatus as claimed in claim 1, wherein:

the apparatus and a load resistor receiving the output signal (Iout) are connected with a lower electric potential (V−).

3. Apparatus as claimed in claim 1, wherein:

said at least one measuring resistor and said adjuster are connected in series;

said measuring resistor is connected with the signal output; and said at least one adjuster is connected with an upper electric potential (V+).

4. The apparatus as claimed in claim 1, further comprising:

at least one voltage reserve arranged in series with said at least one adjuster, which is embodied in such a manner that it prevents falling beneath a minimal voltage drop between the upper potential (V+) and the signal output in the case where the electric resistance of said at least one adjuster is low.

5. A measuring device with an apparatus including:

an apparatus for the output of at least one electrical output signal (Iout), which carries the measured value of a process variable, which can be temperature, fill level, pH-value, electrical conductivity, density or viscosity of a medium in a pipe or in a container, wherein the desired electrical current level of the output signal (Iout) is predeterminable, comprising:

at least one measuring resistor, at which the electrical current level of the output signal (Iout) is measurable;

at least one adjuster, via which the electrical current level of the output signal (Iout) is settable;

at least one controller, which compares the electrical current level of the output signal (Iout) measured at said at least one measuring resistor with the electrical current level desired for the output signal (Iout), and which controls the electrical current level of the output signal (Iout) via said at least one adjuster; wherein:

at least one microprocessor, which provides a digital desired value (Ddes) for the electrical current level of the output signal (Iout);

at least one digital/analog converter which converts the digital desired value (Ddes) of said at least one microprocessor, or a signal (Ddes*) independent thereon, into an analog value (Vdes); and at least one level converter, which adapts the level of said digital/analog converter, wherein:

at least one signal output is provided for issuing the output signal (Iout to a load resistor);

said controller and said measuring resistor are connected with a base-potential (VGND), which changes with said electrical current level of said output signal (Iout) and with the value of the load resistor;

the base-potential (VGND) is a reference potential for said controller;

the measuring device determines and/or monitors at least one process variable of a medium, said adjuster comprises an electrical component having an adjustable electrical resistance; and a connection of said at least one controller for the reference potential (VGND) is connected with a point between said at least one measuring resistor and said at least one adjuster.

* * * * *